US011608622B2

(12) United States Patent
McLeod

(10) Patent No.: US 11,608,622 B2
(45) Date of Patent: Mar. 21, 2023

(54) FLAT TRAP

(71) Applicant: Oakville Stamping & Bending Limited, Oakville (CA)

(72) Inventor: Christopher Adam McLeod, Toronto (CA)

(73) Assignee: Oakville Stamping & Bending Limited, Oakville (CA)

( * ) Notice: Subject to any disclaimer, the term of this patent is extended or adjusted under 35 U.S.C. 154(b) by 98 days.

(21) Appl. No.: 16/938,976

(22) Filed: Jul. 25, 2020

(65) Prior Publication Data

US 2022/0025626 A1 Jan. 27, 2022

(51) Int. Cl.
*E03C 1/284* (2006.01)

(52) U.S. Cl.
CPC ..... *E03C 1/284* (2013.01)

(58) Field of Classification Search
CPC ..... E03C 1/284
USPC ..... 4/679
See application file for complete search history.

(56) References Cited

U.S. PATENT DOCUMENTS 7,134,152 B1 * 11/2006 Batten ..... E03C 1/102 4/679
9,021,628 B2 * 5/2015 Schafer ..... E03F 5/04 4/679
2019/0024356 A1 * 1/2019 McLeod ..... E03C 1/30
2019/0194920 A1 * 6/2019 Trkla ..... E03C 1/284

FOREIGN PATENT DOCUMENTS

GB 973107 A * 10/1964 ..... E03C 1/284
JP 11036403 A * 2/1999

OTHER PUBLICATIONS

JP 11036403 A English Derwent Abstract (Year: 2022).*

* cited by examiner

*Primary Examiner* — Christine J Skubinna
(74) *Attorney, Agent, or Firm* — Harness, Dickey & Pierce, P.L.C.

(57) ABSTRACT

A trap is formed from two instances of a standard part, the ninety degree elbow, and a two-part ninety degree elbow that has a cross-section that runs from circular at the upstream spigot to ovoid at the juncture of the two parts back to circular at the downstream hub. All of the rules that bind trap design in building codes can still be accommodated in this trap architecture. Moreover, the ability of the critical flattened elbow part to be formed from two plastic parts with standard line-of-draw cores reduces entry cost of fabrication. Access to the interior of the parts also allows for novel internal coating strategies. Most importantly for installation, the height of whole trap is reduced by squishing the trap diameter to a degree that a significant drop in trap height is achieved. This decrease in trap height can be sufficient to allow the trap to be accommodated in the reduced height of a vertical space between an underlying ceiling and the underside of the lowered subfloor.

3 Claims, 7 Drawing Sheets

Exploded isometric view of flattened elbow.

Fig. 1. Lateral view of flat elbow

Fig. 2. Lateral view of flat trap assembly.

Fig. 3. Lateral view of trap attached to drain through subfloor.

Fig. 4. Cross-section of trap showing weir height.

Fig. 5. Lateral view comparing traditional trap with flat trap.

Fig. 6. Exploded isometric view of flattened elbow.

FLAT TRAP

FIELD OF THE INVENTION

This invention relates generally to traps, and more particularly to shower drain traps designed to fit in a joist space beneath a shower room floor.

BACKGROUND OF THE INVENTION

With the rise of barrier free bathrooms, installers go in the only direction not proscribed: down, into the joist space. The height of this space is often limited, and the big trap that hung there under a shower drain might no longer fit between the ceiling of the room below and the floor of the bathroom above.

A trap is a drainage device that connects a drain to a sanitary drain. Its purpose is to maintain a weir, a height of standing water that inhibits the passage of sewer gases from the downstream sanitary drain into the upstream drain surroundings. Weir height is the vertical distance between the lowest point of the upper internal surface of the trap to the lowest point of the upper internal surface of the higher downstream discharge arm.

Traps have the same cross-sectional area as the pipe they connect. Hitherto, the easiest way to make a trap with constant cross-sectional area was to take a piece of pipe and bend it to make a trap, or reproduce the same in plastic with complex curved slides in molds. Several design limitations arise from this plan. First, the inner surface of the trap bend, the "U-bend", is entirely inaccessible for modification; for example, antimicrobial coatings. Second, the cost of production is high. Third, by maintaining a circular cross-section throughout the length of the trap, and given the standard weir height of two inches throughout North America, there is no way to decrease the overall height of the trap. In the explanation below, a hub refers to a circular feature on terminus of a plumbing fitting that first a connecting pipe, and a spigot refers to a pipe used in the system. Spigots fit to hubs just like pipe. Joists are vertical beams that support the subfloor, most often plywood.

As washrooms across North America become barrier free, the curb that was used to separate the shower base and drain from the rest of the bathroom floor is increasingly no longer used. The surroundings of the shower drain floor is now flush with the hallway floor. Accordingly, any slope in a shower drain encouraging surface water to run toward a drain must be achieved by lowering the shower floor, either around a point or toward a linear drain. This is achieved by tactics such as cutting out a portion of the subfloor and filling spaces in between the now exposed joists. This allows for enough difference in height to enable a slope for smaller shower beds to be built. If the drain toward which the slope descends is a linear drain; however, notches in said joists must be cut to accommodate the tray in said linear drains to keep the top of the linear drain flush with the bottom of the slope, meaning that the hub is on the bottom or even side of the tray is even lower.

The space beneath the subfloor and the ceiling below, barely accommodates a trap of the standard diameter required for showers by the building code. Once floor lowering tactics such as described above are used, there may no longer be enough vertical height to accommodate a standard trap for showers.

SUMMARY OF THE INVENTION

Accordingly, it is an object of the invention to at least partially overcome some of the disadvantages of the prior art.

The device of the present invention is formed from two instances of a standard part, a ninety degree elbow, and a two-part ninety degree elbow that has a cross-section that runs from circular at the upstream spigot to ovoid at the juncture of the two parts back to circular at the downstream hub. All of the rules that bind trap design in building codes can still be accommodated in this trap architecture. Moreover, the ability of the critical flattened elbow part to be formed from two plastic parts with standard line-of-draw cores reduces entry cost of fabrication. Access to the interior of the parts also allows for novel internal coating strategies. Most importantly for installation, the height of whole trap is reduced by squishing the trap diameter to a degree that a significant drop in trap height is achieved. This decrease in trap height can be sufficient to allow the trap to be accommodated in the reduced height of a vertical space between an underlying ceiling and the underside of the lowered subfloor.

BRIEF DESCRIPTION OF THE DRAWINGS

In the drawings, which illustrate embodiments of the invention.

DETAILED DESCRIPTION OF THE INVENTION

The Invention described herein is a novel flat trap fitting for a plurality of shower drain installation types in which a flat trap assembly is assembled from two ninety degree elbows connected by a flattened 90 degree elbow.

Figure 1:
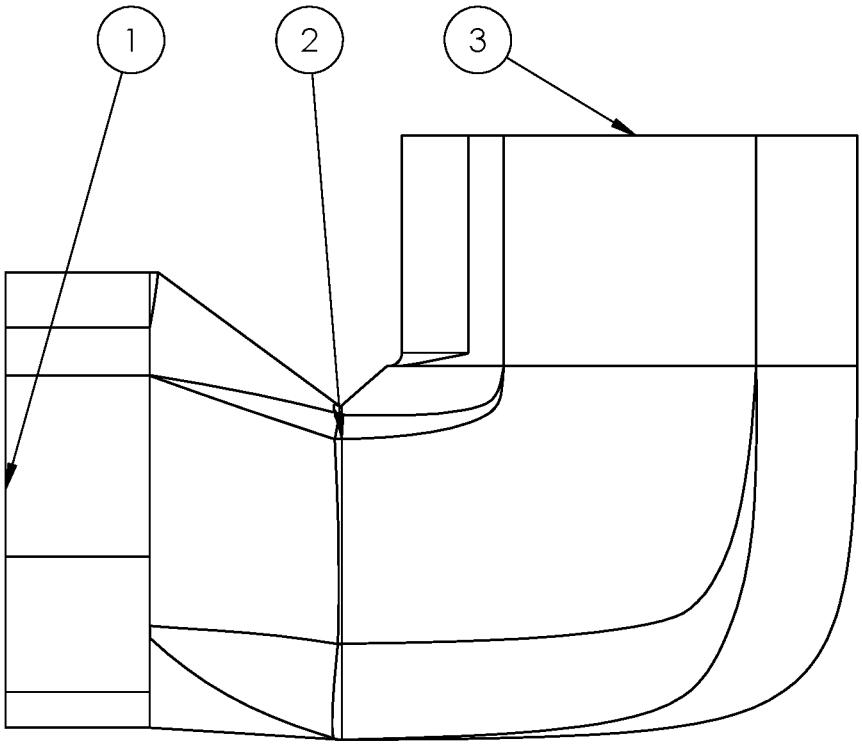
FIG. 1 shows a lateral view of a flat elbow.

A lateral view of a flat elbow in FIG. 1 shows an upstream spigot 1 leading to a flattened constriction 2 leading to a downstream spigot 3.

Figure 2:
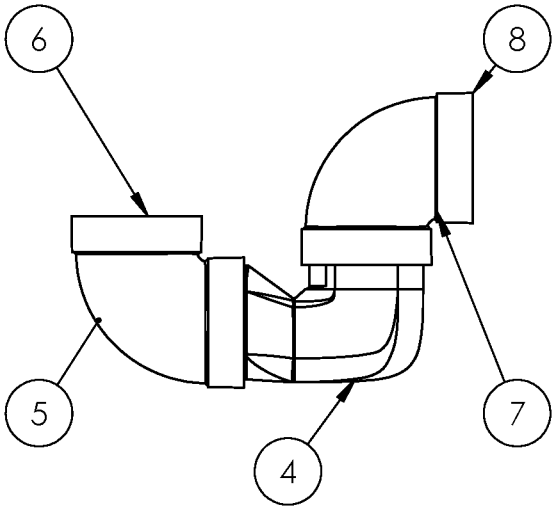
FIG. 2 shows a lateral view of a flat trap assembly.

A lateral view of a flat trap assembly 30 in FIG. 2 shows a two-spigot flat elbow 4 connected with appropriate adhesive to two conventional ninety degree elbows 5 and 7. An upstream hub 6 on the upstream ninety degree elbow 5 is connected to the flattened ninety degree elbow 4, and at the other end of the elbow 4 is connected to a downstream ninety degree elbow with downstream hub 8. The two hubs are for attachment to upstream and downstream pipe. The three elbows comprise a trap.

Figure 3:
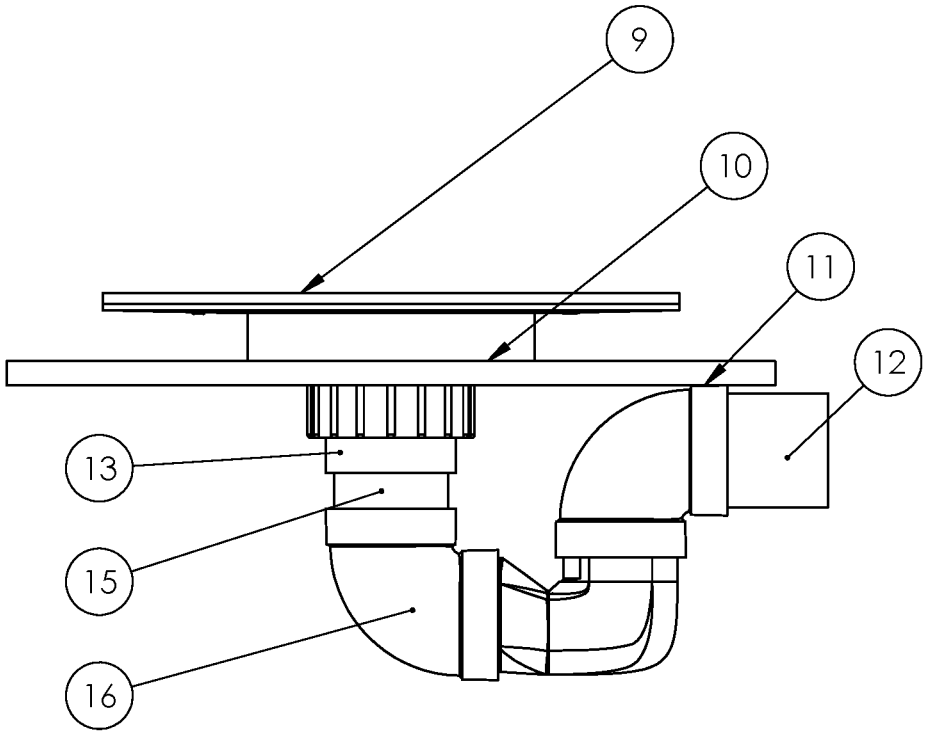
FIG. 3 shows a lateral view of a flat trap assembly attached to a drain hub though a subfloor.

FIG. 3 shows a lateral view of the trap assembly 30 attached to a floor drain 9 fitted to a subfloor 10 that suspends a downstream hub 13 attached to a pipe 15 further attached to the trap assembly 30 further attached to a pipe 12. Of particular note is the point of contact 11 between the highest point of the trap and the underside of the subfloor 10. This limitation determines the length of the pipe 15 necessary to connect the trap to the drain.

Figure 4:
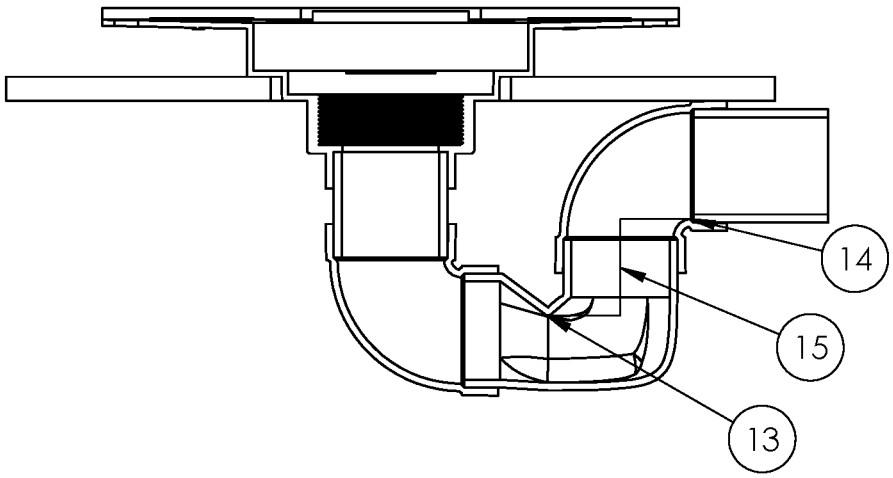
FIG. 4 shows a lateral cross section of a flat trap assembly attached to a drain through a subfloor.

A lateral cross section of the trap assembly 30 connected downstream to a subfloor-mounted drain is shown in FIG. 4. Of note is the formation of the weir, defined as the height difference 15 between the highest point 16 on the underside of the interior of the upstream lower internal void of the flattened elbow and the lowermost point 14 of the internal void of the higher downstream egress of drain water. The entire purpose of a trap is to set up a weir that traps drainage water to prevent sewer gas rising up from the sanitary sewer. For example weir height is set for standard bathroom fixtures at two inches. This height requirement limits reduction of the overall height of the trap.

Figure 5:
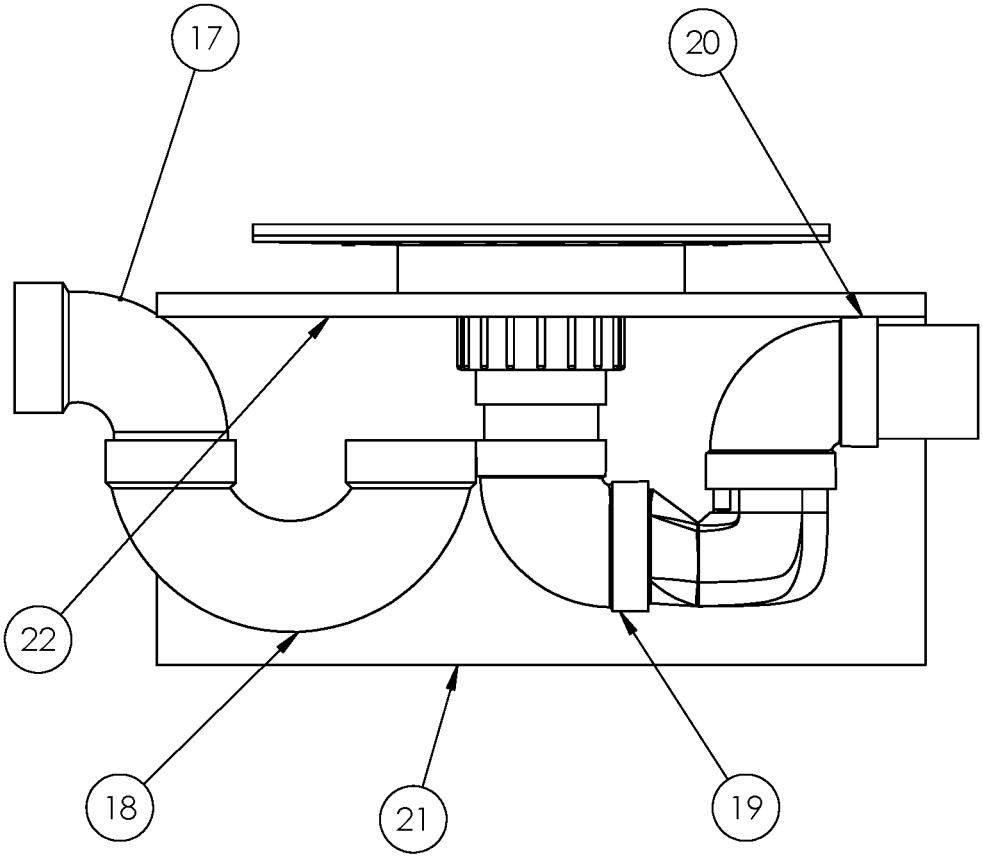
FIG. 5 shows a lateral view of a comparison of a regular trap and a flat trap.

The lateral view shown in FIG. 5 illustrates how a standard trap 28 on the left with the same weir height not only drops lower at a bottom 18 of the trap than a bottom 19 of the trap assembly 30 but also rises much higher downstream at 17 than the highest point 20 of the trap assembly 30. This greater height requires greater vertical space for a conventional trap than for the flattened trap. In some cases, the height requirement for the conventional trap may be greater than the space available between an underside 22 of the subfloor 10 and a lower limit 21 of a floor joist. This requires extraordinary accommodation of the trap resulting in either bumps in the ceiling below or the necessity of using a smaller diameter trap. A smaller trap drains less water and contravenes building code.

Figure 6:
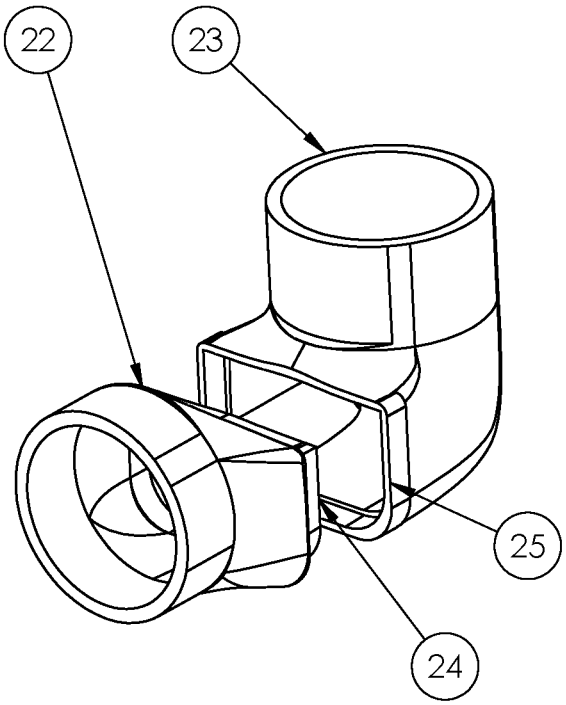
FIG. 6 shows an exploded isometric view of the two component parts of the flattened elbow of the trap.

FIG. 6 shows an exploded isometric view of the flat elbow 4. As can be seen in FIG. 6, the cross-sectional shape of the elbow changes from circular at an upstream spigot 1 to ovoid or rectangular partway downstream returning to a circular shape at the downstream spigot 3. The two parts of the elbow are connectable via a lip 24 insertable into a groove 25. The components would typically be assembled using a suitable adhesive cement. A benefit of the two-part construction is reduced mold costs and an ability to access an interior of the two-part elbow to apply an antimicrobial coating. A suitable antimicrobial coating would be a brass alloy ring inserted into the diameter of the downstream spigot 1.

Figure 7:
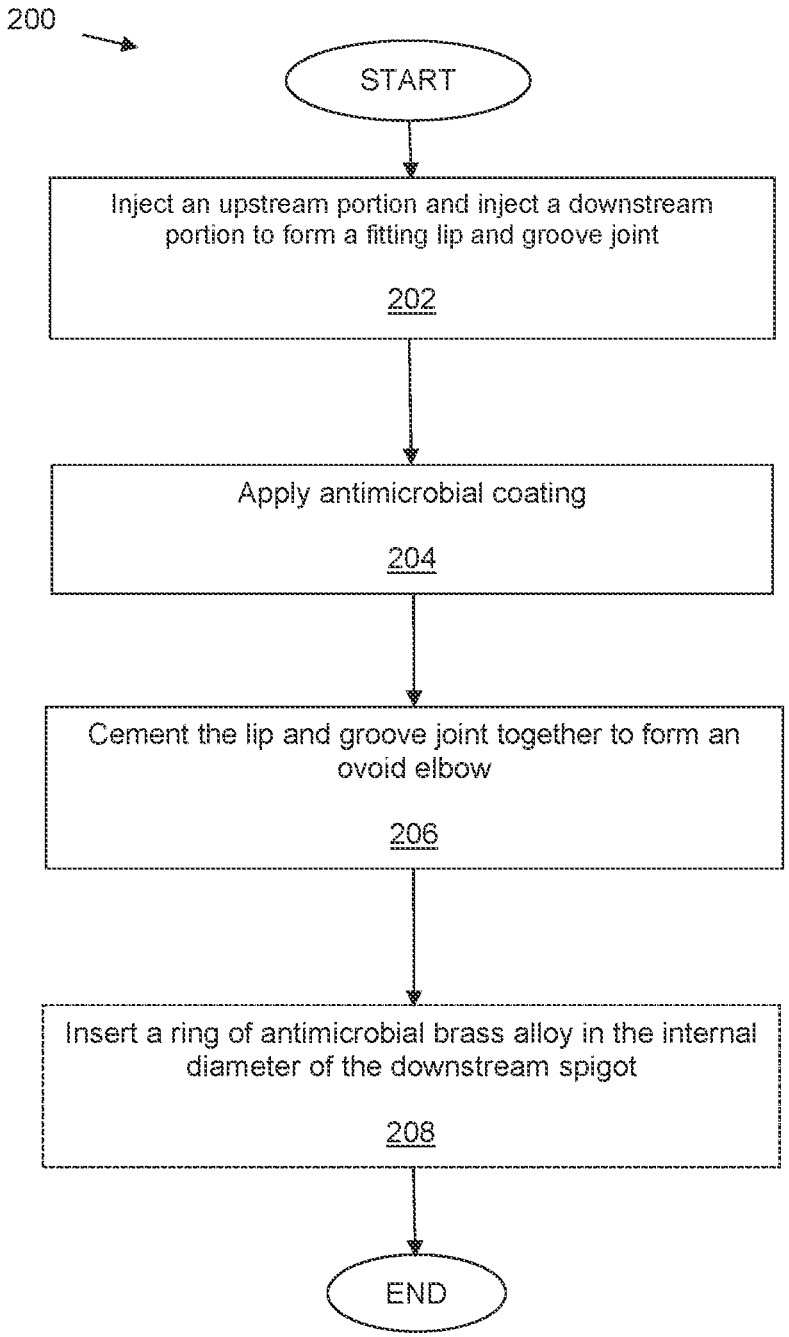
FIG. 7 illustrates a method of manufacturing in accordance with the present disclosure.

FIG. 7 shows a method in accordance with the present disclosure. At block 202, the method includes injecting an upstream portion and injecting a downstream portion to form a fitting lip and groove joint. At block 204, an antimicrobial coating is applied. At block 206, the lip and groove joint are cemented together to form an ovoid elbow. At block 208, a ring of antimicrobial brass alloy is inserted in the internal diameter of the downstream spigot.

The invention claimed is:

1. A two-spigot ninety-degree elbow for connecting an upstream ninety-degree elbow and a downstream ninety-degree elbow, the two-spigot ninety-degree elbow comprising:

a circular upstream spigot;

a circular downstream spigot oriented at a ninety-degree angle relative to the circular upstream spigot; and a body portion extending from the circular upstream spigot to the circular downstream spigot, from the circular upstream spigot the body portion tapers outward to a maximum width that is wider than the circular upstream spigot and wider than the circular downstream spigot, an upper surface of the body portion tapers downward from the circular upstream spigot to the maximum width as the upper surface extends from the circular upstream spigot, a lower surface of the body portion extends linearly from the circular upstream spigot to, and across, the maximum width;

wherein a cross-sectional area of an interior of the two-spigot ninety-degree elbow remains largely constant from the circular upstream spigot, across the body including the maximum width, and to the circular downstream spigot.

2. A trap assembly including the two-spigot part elbow of claim 1, wherein the two-spigot elbow connects to the upstream ninety-degree elbow and the downstream ninety-degree elbow to form a drain trap achieving a two inch standard weir height despite the overall height of the trap being shorter than a conventional trap with the same internal cross-sectional area.

3. A method of manufacturing the two-spigot elbow of claim 1, comprising:

injecting an upstream portion and separately injecting a downstream portion to form a fitting lip and groove joint; and assembling by cementing together the upstream portion and the downstream portion to form the two-spigot elbow.

* * * * *